US006206688B1

(12) United States Patent
Hunter

(10) Patent No.: US 6,206,688 B1
(45) Date of Patent: Mar. 27, 2001

(54) DECORATIVE ASSEMBLY

(76) Inventor: Sheila Hunter, 3521 W. Marlette Ave., Phoenix, AZ (US) 85019

( * ) Notice: Subject to any disclaimer, the term of this patent is extended or adjusted under 35 U.S.C. 154(b) by 0 days.

(21) Appl. No.: 09/357,430

(22) Filed: Jul. 20, 1999

(51) Int. Cl.[7] ..... A47G 19/22; F21V 35/00

(52) U.S. Cl. ..... 431/126; 431/296; 215/386; D7/507; D7/560; D26/10

(58) Field of Search ..... 431/126, 296; 362/161, 101; 428/7; 248/534; 215/386, 388, 390, 391; 220/703, 735, 759, 769; D7/507, 509, 560, 396.2, 396.3; D11/130, 117, 121; D26/10, 23

(56) References Cited

U.S. PATENT DOCUMENTS 589,821 9/1897 Ebeling .
2,260,411 * 10/1941 Smith ..... D7/396.2
2,658,297 11/1953 Woolsey .
2,786,345 3/1957 Scherer .
3,298,206 * 1/1967 Hingston ..... 215/386
4,399,494 8/1983 Perkins .
4,775,060 * 10/1988 Pinney ..... 215/391
4,839,784 6/1989 Lin .

FOREIGN PATENT DOCUMENTS

H6-297900 * 10/1994 (JP) .

* cited by examiner

*Primary Examiner*—Ira S. Lazarus
*Assistant Examiner*—Sara Clarke
(74) *Attorney, Agent, or Firm*—Parsons & Goltry; Michael W. Goltry; Robert A. Parsons

(57) ABSTRACT

Decorative apparatus comprising the assemblage of a receptacle of a type for accommodating a consumable liquid and a decorative assembly constructed to accommodate a candle for casting a decorative light when lit.

11 Claims, 2 Drawing Sheets

DECORATIVE ASSEMBLY

FIELD OF THE INVENTION

This invention concerns decorative devices and, more particularly, a decorative assembly for use with a receptacle of a type for accommodating a consumable liquid.

BACKGROUND OF THE INVENTION

The art of decorating is one of furnishing, providing or adorning something with ornamentation. Whether decorating a room, a table or an office, skilled artisans, especially professional or interior decorators, devote considerable attention toward personal, professional and customer needs when selecting among specific design choices. Although the art is replete with decorative apparatus and structural fixtures for accommodating decorative items, the field of decorative apparatus is want for certain new and useful improvements.

Accordingly, it would be highly desirable to contribute to the art of decorative apparatus by providing a new and useful decorative assembly for use with a receptacle of a type for accommodating and serving a consumable liquid such as water, ice tea, wine, champagne, or other consumable liquid.

It is a purpose of the invention to provide a new and improved decorative assembly that is easy to install with a receptacle of a type for accommodating and serving a consumable liquid.

It is another purpose of the invention to provide a new and useful decorative assembly that is easy to construct.

It is another purpose of the invention to provide a new and improved decorative assembly that is easy to use.

It is still another purpose of the invention to provide a new and improved decorative assembly that is inexpensive.

SUMMARY OF THE INVENTION

The above problems and others are at least partially solved and the above purposes and others realized in new and improved decorative apparatus. The decorative apparatus comprises the assemblage of a receptacle and a decorative assembly. The receptacle includes a base supporting a continuous sidewall having a continuous outer surface and an open end bound by a rim leading to a well for accommodating a consumable liquid. The decorative assembly is comprised of a body supported by the receptacle and a decorative element carried by the body. The body includes an engagement element, a groove accommodating a point of the rim and an abutment resting against a point of the outer surface of the receptacle. The decorative element supports a complemental engagement element engaged to the engagement element such that the body supports the decorative element away from the outer surface of the receptacle. The body preferably includes a platform that supports a candle away from, and in substantial opposition to, the open end of the receptacle. The engagement element comprises one of a male engagement element and a female engagement element, and the complemental engagement element comprises the other one of the male engagement element and the female engagement element.

BRIEF DESCRIPTION OF THE DRAWINGS

The foregoing and further and more specific objects and advantages of the invention will become readily apparent to those skilled in the art from the following detailed description thereof taken in conjunction with the drawings in which.

DETAILED DESCRIPTION OF A PREFERRED EMBODIMENT

Figure 1:
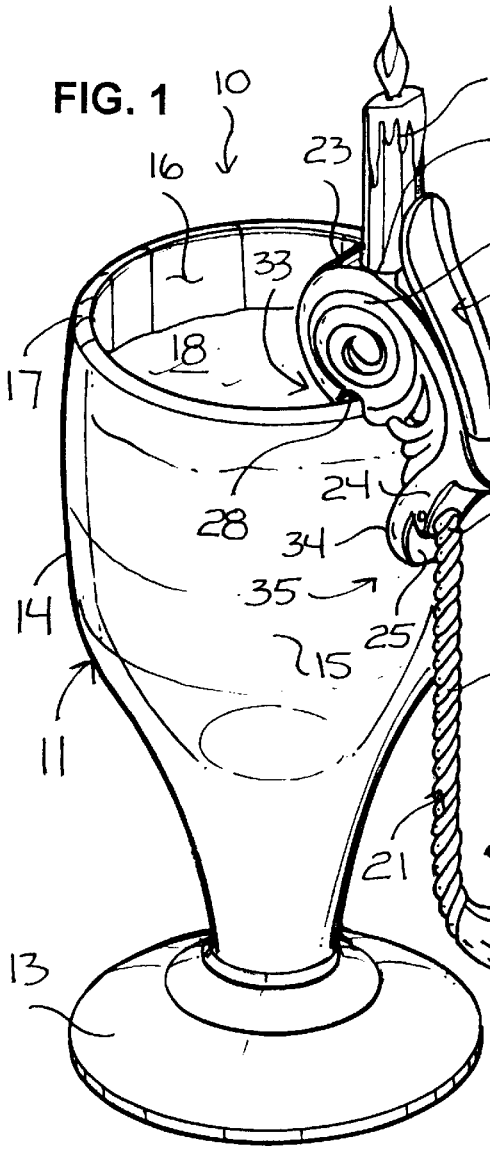
FIG. 1 is a perspective view of decorative apparatus comprising a decorative assembly supported by a receptacle of a type for accommodating and serving a consumable liquid, the decorative assembly having a body engaged to the receptacle, a decorative element supported by the body and a decorative attachment carried by the decorative element.

Turning to the drawings, in which like reference characters indicate corresponding elements throughout the several views, attention is first drawn to FIG. 1 illustrating a perspective view of decorative apparatus 10, in accordance with the invention. Decorative apparatus 10 comprises the assemblage of a receptacle 11 and a decorative assembly 12. Receptacle 11 is of a type constructed and designed specifically for accommodating a consumable liquid such as water, ice tea, juice, wine, champagne, etc. Receptacle includes a base 13 engagable so as to rest against a support surface in an upright condition. Base 13 leads to and supports a continuous sidewall 14 having a continuous outer surface 15 and an open end 16 bound by a rim 17 leading to a well 18 for accommodating or holding a consumable liquid. Consistent with this structure, receptacle 11 may comprise a tumbler, a wineglass, a champagne glass, a beer glass, etc.

Figure 2:
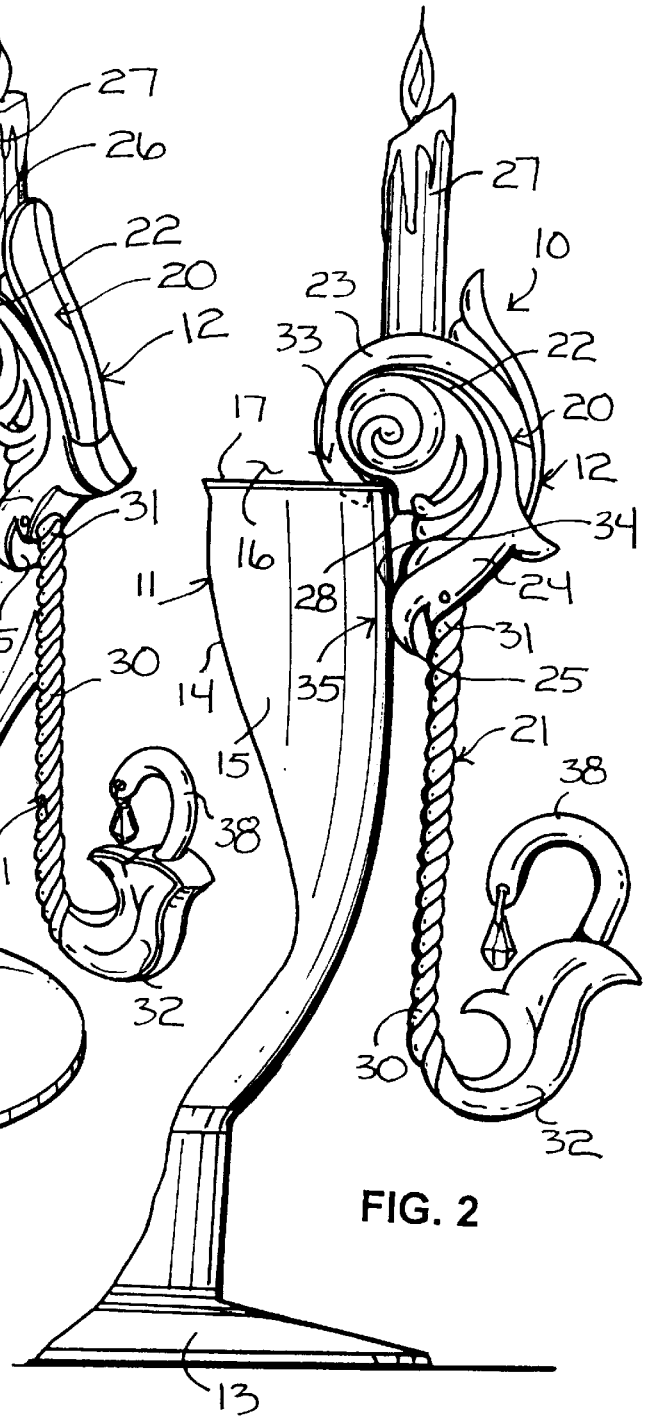
FIG. 2 is a side view of the decorative assembly of FIG. 1 shown as it would appear supported by the receptacle.
Figure 3:
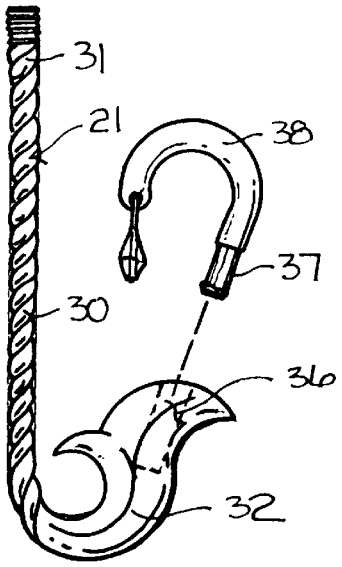
FIG. 3 is a side view of the decorative attachment of FIG. 1 shown as it would appear detached from the decorative element.

Decorative assembly 12 may be constructed of plastic, a wax or wax-like material, a selected metal, wood or the like, and is comprised of a body 20 and a decorative element 21. Regarding FIGS. 1 and 2, body 20 defines a decorative shape that, in this embodiment, is characterized by swirling and curvaceous features. Body 20 can be provided in any form of decorative shape or pleasing shape. In form, body 20 includes an enlarged portion 22 defining a proximal extremity 23, and an opposing narrowed portion 24 defining a distal extremity 25. Enlarged portion 22 supports or defines a platform 26 (shown only in FIG. 1) at proximal extremity 23 for accommodating a candle 27, and a groove 28 that opposes platform 26. Groove 28 faces distal extremity 25. Body 20 supports decorative element 21 at distal extremity 25. In this embodiment, decorative element 21 is comprised of an elongate body 30 having a proximal end 31 coupled to body 20 at or adjacent distal extremity 25. Elongate body 30 leads away from distal extremity 25 and terminates with a distal end 32 that is outwardly curved. Distal end 32 may be provided in the form of any decorative shape such as the shape of a sash, a flower, an inverted fluted decorative shape, etc. Regarding a specific embodiment of decorative element 21 as shown best in FIG. 3, distal end 32 supports a recess 36 for accommodating a head 37 of a decorative attachment 38. FIGS. 1 and 2 show decorative attachment 38 as it would appear carried by distal end 32.

Decorative assembly 12 is engagable so as to be supported by receptacle 11 for forming decorative apparatus 10. In engagement, groove 28 accommodates a point or area 33 of rim 17, and an abutment 34 defined by narrowed portion 24 at distal extremity 25 rests against a point or area 35 of continuous outer surface 15 of receptacle 11 toward base 13 away from rim 17. Point 33 could be any point along rim 17. So engaged to receptacle 11, the bulk of body 20 resides outboard of continuous outer surface 15 of receptacle 11 as best seen in FIG. 2, proximal extremity 23 extends outwardly from open end 16 and distal extremity 25 reaches toward base 13. When accommodating candle 27 in this regard, platform 26 supports candle 27 away from, and in substantial opposition to, open end 16 of receptacle 11. Candle 27 may, of course, be lit for casting a decorative light. Also, decorative element 21 is coupled to body 20 so that it extends from distal extremity 25, downwardly toward base 13 and away or spaced from outer surface 15 of receptacle 11.

Figure 4:
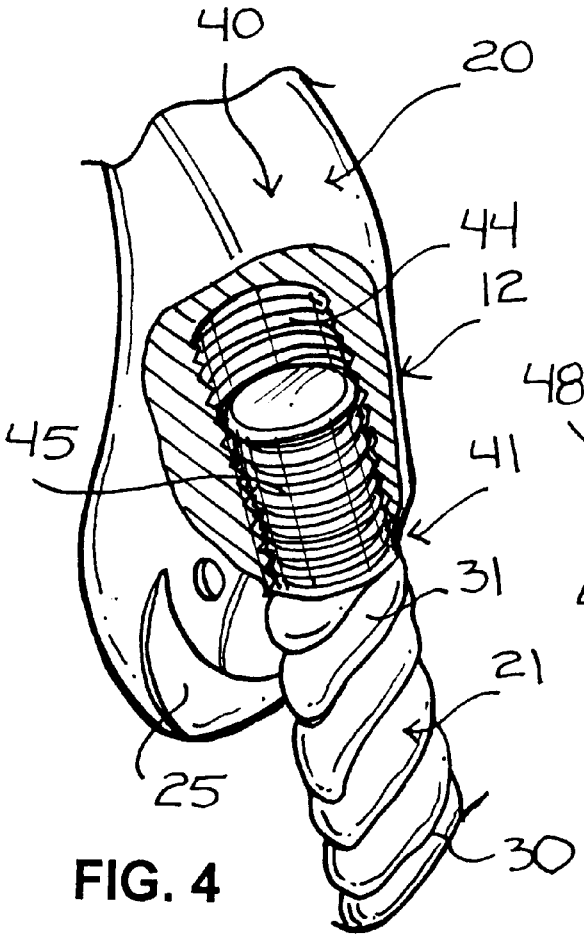
FIG. 4 is a fragmented perspective view of an engagement assembly for detachably securing the decorative element to the body of the decorative assembly of FIG. 1.
Figure 5:
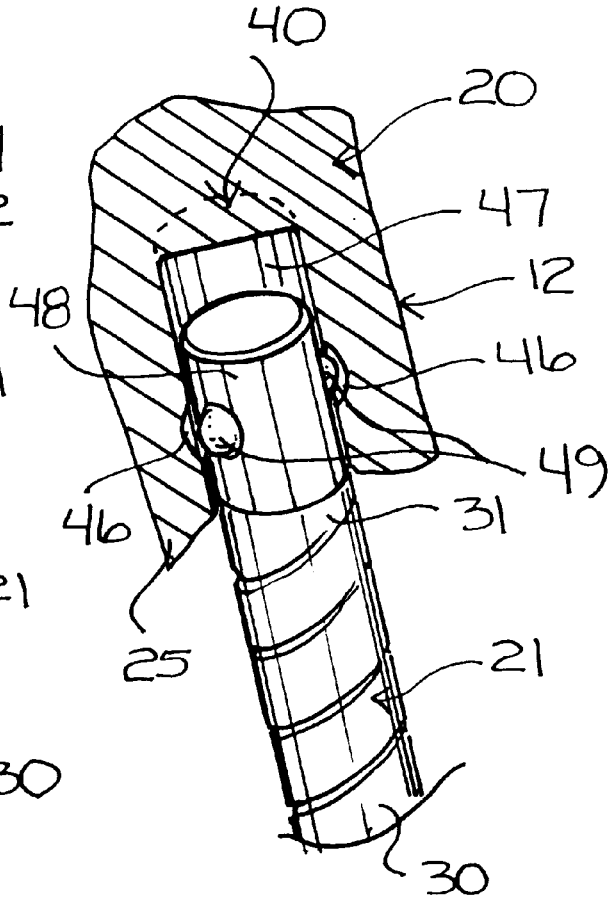
FIG. 5 is a fragmented perspective view of another embodiment of an engagement assembly for detachably securing the decorative element to the body of the decorative assembly of FIG. 1.

Engagement structure facilitates the detachable engagement of decorative element 21 to body 20, such that body 20 supports decorative element 21 away from outer surface 15 of receptacle 11 when mounted to receptacle 11. As a result of this engagement structure, a user may choose from a variety of decorative elements and interchange them as needed for accomplishing desired decorative ends. Turning to FIG. 4, an exemplary embodiment of engagement structure comprises an engagement element 40 carried by body 20 at distal extremity 25, and a complemental engagement element 41 carried by decorative element 21 at proximal end 31. Engagement element 40 comprises a female engagement element or structure and complemental engagement element 41 comprises a male engagement element or structure, although this positioning may be reversed. In FIG. 4, the female engagement element includes an internally threaded blind bore 44, and male engagement element comprises a complementary externally threaded head 45. Threaded head 45 is engagable to threaded blind bore 44 in a conventional manner. Regarding another embodiment in FIG. 5, the female engagement element includes recesses 46 formed into a blind bore 47, and the male engagement element includes a head 48 that supports spring-loaded protuberances pins 49 that detachably engage the recesses 46 when head 48 is forced into blind bore 47. Other engagement structure that will readily occur to the skilled artisan for removably coupling decorative element 21 to body 20 are intended to be included within the scope of this invention.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A decorative apparatus comprising:

a receptacle including a base supporting a continuous sidewall having a continuous outer surface and an open end bound by a rim leading to a well;

a body supported by the receptacle and having an engagement element, a groove accommodating a point of the rim, an abutment resting against a point of the outer surface of the receptacle and a platform supporting a candle; and a decorative element having a complemental engagement element engaged to the engagement element of the body such that the body supports the decorative element away from the outer surface of the receptacle.

2. The decorative apparatus of claim 1, wherein the platform supports the candle away from, and in substantial opposition to, the open end of the receptacle.

3. The decorative apparatus of claim 1, wherein the engagement element of the body comprises one of a male engagement element and a female engagement element.

4. The decorative apparatus of claim 3, wherein the complemental engagement element comprises the other one of the male engagement element and the female engagement element.

5. In a receptacle including a base supporting a continuous sidewall having a continuous outer surface and an open end bound by a rim leading to a well, a decorative assembly comprising:

a body having an engagement element, a groove engagable to a point of the rim, an abutment engagable against a point of the outer surface of the receptacle and a platform for accommodating a candle; and a decorative element having a complemental engagement element engagable to the engagement element of the body such that the body supports the decorative element away from the outer surface of the receptacle when the body is engaged to the receptacle at the first and second points.

6. The decorative assembly of claim 5, wherein the engagement element of the body comprises one of a male engagement element and a female engagement element.

7. The decorative assembly of claim 6, wherein the complemental engagement element comprises the other one of the male engagement element and the female engagement element.

8. A decorative apparatus comprising:

a receptacle constructed and designed specifically for accommodating a consumable liquid, the receptacle including a base supporting a continuous sidewall having a continuous outer surface and an open end bound by a rim leading to a well for accommodating a consumable liquid;

a body supported by the receptacle and having a platform supporting a candle, an engagement element, a groove accommodating a point of the rim and an abutment resting against a point of the outer surface of the receptacle; and a decorative element having a complemental engagement element engaged to the engagement element of the body such that the body supports the decorative element away from the outer surface of the receptacle.

9. The decorative apparatus of claim 8, wherein the platform supports the candle away from, and in substantial opposition to, the open end of the receptacle.

10. The decorative apparatus of claim 8, wherein the engagement element of the body comprises one of a male engagement element and a female engagement element.

11. The decorative apparatus of claim 10, wherein the complemental engagement element comprises the other one of the male engagement element and the female engagement element.

* * * * *